US005408801A

United States Patent [19]

Molinaro

[11] Patent Number: 5,408,801

[45] Date of Patent: Apr. 25, 1995

[54] OUTBOARD BOTTLE SUPPORT SUPPORT APPARATUS FOR BOTTLE CAPPING MACHINES

[76] Inventor: Luca Molinaro, 246 Chippewa Dr., New Castle, Pa. 16105

[21] Appl. No.: 316,893

[22] Filed: Oct. 3, 1994

[51] Int. Cl.[6] ..... B65B 61/00; B65B 7/28; B67B 3/00

[52] U.S. Cl. ..... 53/300; 53/331.5

[58] Field of Search ..... 53/300, 331.5, 317, 53/319, 282, 287

[56] References Cited

U.S. PATENT DOCUMENTS

| | | | |
|---|---|---|---|
| 1,041,527 | 10/1912 | Taylor | 53/300 |
| 1,055,796 | 3/1913 | Recht | 53/300 |
| 1,912,677 | 6/1933 | Williams | 53/300 X |
| 3,179,237 | 4/1965 | Ninneman . | |
| 3,418,193 | 12/1968 | Hallowell, Jr. | 53/300 X |
| 3,432,989 | 3/1969 | Bouzereau | 53/300 X |
| 3,875,725 | 4/1975 | Carmichael | 53/300 X |
| 4,095,390 | 6/1978 | Knudsen | 53/300 X |
| 4,114,347 | 9/1978 | Morris et al. | 53/300 |
| 4,624,098 | 11/1986 | Trendel | 53/331.5 X |
| 4,658,565 | 4/1987 | Westbrook et al. | 53/331.5 X |
| 4,939,890 | 7/1990 | Peronek et al. | 53/331.5 X |
| 5,197,258 | 3/1993 | Johanek | 53/331.5 X |

*Primary Examiner*—Horace M. Culver
*Attorney, Agent, or Firm*—Harpman & Harpman

[57] ABSTRACT

A bottle support apparatus to supply additional outboard support to a resilient thermoplastic bottle during capping with a bottle capping device. The outboard support device provides additional arcuate support for the bottle neck by encircling the remaining free portion of the lower bottle neck not engaged by the capping machine so that thin walled thermoplastic resin bottles will not be distorted by the force of the capping machine during operation.

6 Claims, 2 Drawing Sheets

OUTBOARD BOTTLE SUPPORT SUPPORT APPARATUS FOR BOTTLE CAPPING MACHINES

BACKGROUND OF THE INVENTION

1. Technical Field

This invention relates to capping machines used for cupping lightweight thin walled resilient thermoplastic bottles. Cupping machines exert high compression axial forces against the bottle necks daring insertion and sealing of the tamper evident caps thereon.

1. Description of Prior Art

Prior art cupping machines and processes have used a variety of bottle supporting carriers that engage and hold lower neck portions of a bottle daring the cupping process, see for example U.S. Pat. Nos. 5,197,258, 4,939,890, 4,114,347, 3,875,725, 3,179,237 and 1,912,677.

In U.S. Pat. No. 5,197,258 a screw capping device is disclosed which has a pre-selected torque feature and multiple bottle neck engagement arms.

U.S. Pat. No. 4,939,890 is directed to an anti-rotation method and apparatus for capping machines that grips the bottle neck from the oppositely disposed sides holding the bottle from rotation during the capping action.

U.S. Pat. No. 4,114,347 discloses a capping apparatus that suspends a container by its outwardly extending flange during the capping action by a collar on one side of the cap and a container.

In U.S. Pat. No. 3,875,725 a process for capping lightweight thermoplastic bottles is disclosed wherein a pair of opposing jaws pivot together to secure the bottle therebetween.

U.S. Pat. No. 3,179,237 is directed to an apparatus for closing plastic bottles wherein two parallel pads are advanced from opposing endless chains to grip the bottle.

U.S. Pat. No. 1,912,677 discloses pivoting jaw configurations that are advanced together under the supporting neck portion of the bottle during the capping operation.

SUMMARY OF THE INVENTION

An outboard multiple sided bottle support apparatus that selectively engages each thermoplastic bottle as it is held within the capping machine at the point of cap insertion to provide a continuous neck support between the capping machine support and the outboard multiple sided bottle support apparatus.

DESCRIPTION OF THE PREFERRED EMBODIMENT

Figure 1:
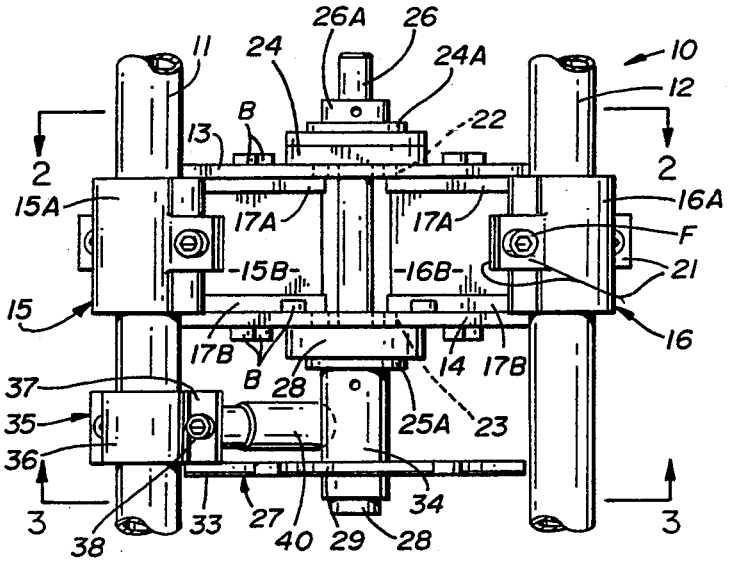
FIG. 1 is a front plan view of the outboard bottle supporting apparatus.
Figure 5:
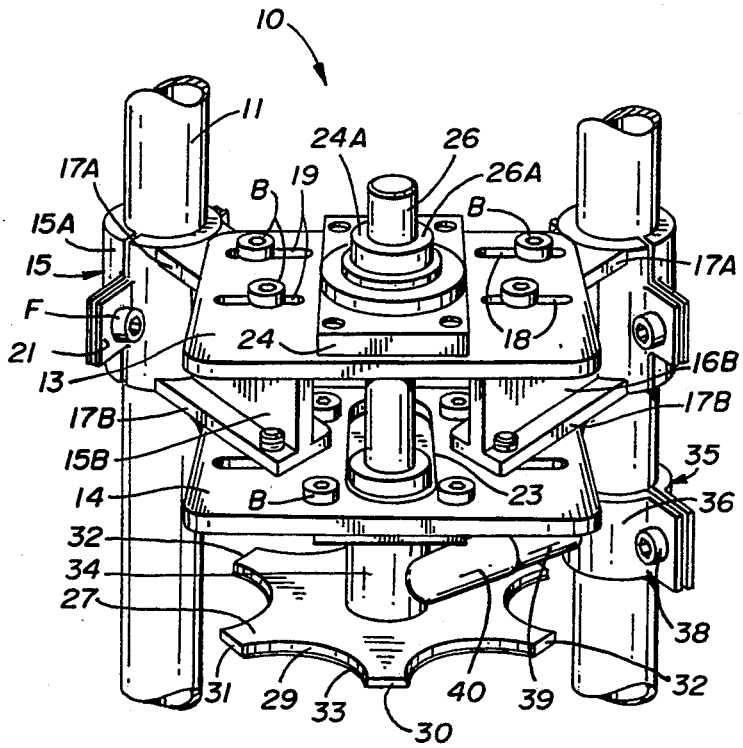
FIG. 5 is a top front perspective view of the invention.

Referring to the drawings and FIGS. 1 and 5 in particular an outboard capping device 10 is shown adjustably secured to a pair of parallel spaced supporting and mounting tubes 11 and 12. The outboard capping device

10 has a pair of vertically spaced horizontally disposed frame elements 13 and 14 adjustably secured to respective mounting brackets 15 and 16. Each of said mounting brackets 15 and 16 have a sleeve portion 15A and 16A respectively and a frame engagement portions 15B and 16B with oppositely disposed upper and lower apertured flanges 17A and 17B thereon. Each of said mounting brackets 15 and 16 are arranged in interengaging angular abutting relation between said respective frame element pairs 13 and 14 that have respective pairs of spaced elongated apertures therein at 18 and 19.

Figure 2:
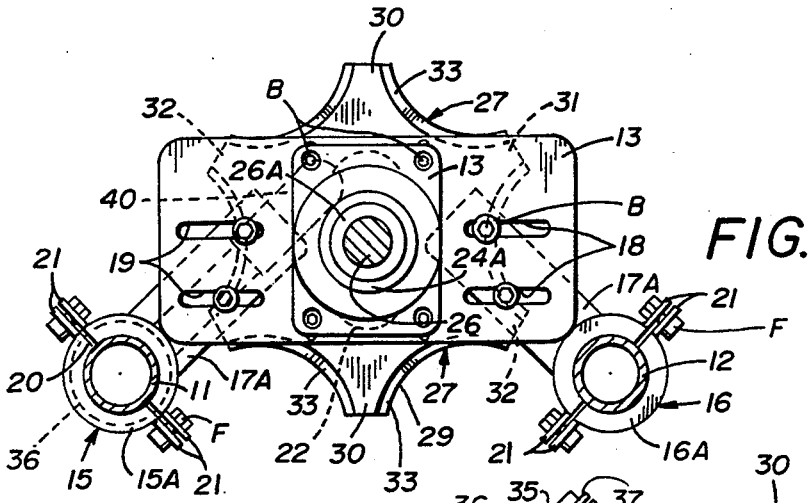
FIG. 2 is a sectional view on lines 2—2 of FIG. 1 of the invention.
Figure 3:
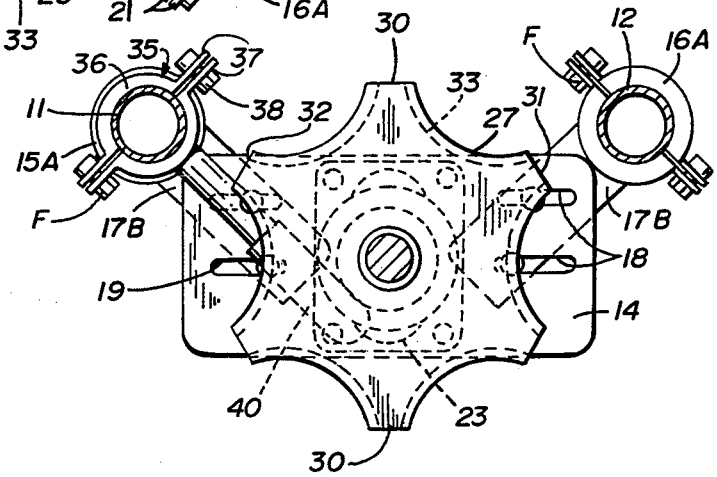
FIG. 3 is a sectional view on lines 3—3 of FIG. 1 of the invention.

In the embodiment chosen for illustration each of the mounting brackets sleeve portions 15A and 16A are of a split sleeve configuration at 20 with respective pairs of outwardly extending interengaging locking tabs 21 as best seen in FIGS. 2 and 3 of the drawings. Each tab pair has aligned apertures within and a interconnecting nut and bolt fastener F therethrough. Adjustment bolts B adjustably secure the respective frame elements 13 and 14 to respective front frame engagement portions 17A and 17B via said hereinbefore described aligned apertures therein.

The frame elements 13 and 14 have a central opening at 22 and 23 respectively on which is positioned bearing support blocks 24 and 25 with bearing assemblies 24A and 25A positioned therein as will be well known and understood by those skilled in the preferred art.

An indexing spindle 26 extends through said aligned bearing assemblies 24A and 25A having a support star wheel 27 secured thereto inwardly of its free end at 28 in spaced relation to said frame element 14 and associated bearing support block 25. The support star wheel 27, best seen in FIGS. 1, 3 and 5 of the drawings has arcuate engagement portions 29 between multiple pairs of oppositely disposed spoke portions 30, 31, and 32 as is typical of a star wheel configuration. Each of said bottle engagement portions has an arcuate outwardly extending flange 33 thereon which will be described in greater detail hereinafter.

The indexing spindle 26 has oppositely disposed retainer rings 26A and 26B as will be well understood by those skilled in the art to retain the spindle within the bearing assemblies.

A braking sleeve 34 is positioned on the indexing spindle 26 between said star wheel 27 and the front element 14.

Figure 4:
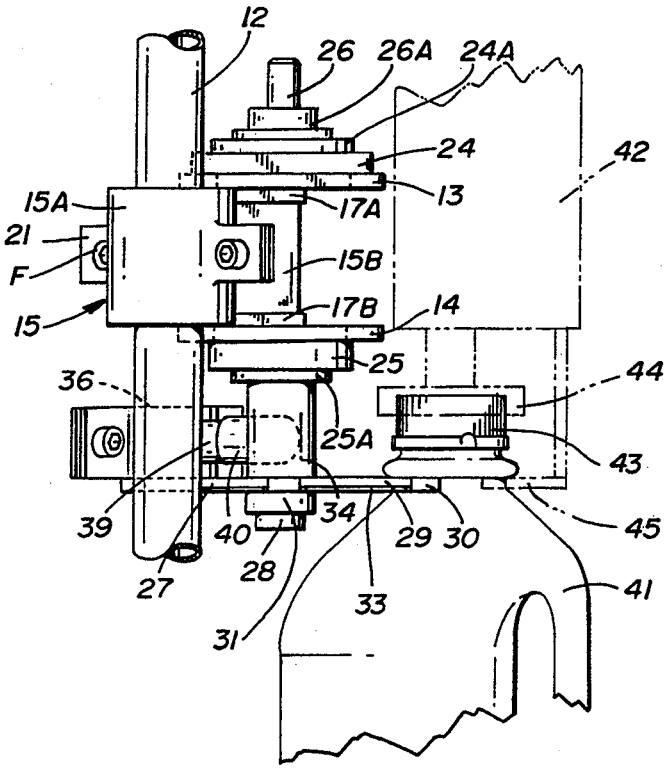
FIG. 4 is a side elevational view of the invention in operation with portions of a capping machine shown in broken lines.

Referring to FIGS. 1, 4 and 5 of the drawings, a brake assembly 35 can be seen having a mounting bracket 36 secured to the mounting tube 12 by integral flanges 37 and threaded fasteners 38. A brake support shaft 39 extends from said mounting bracket 36 having a synthetic resilient end portion 40 that is registerably engaged on the hereinbefore described braking sleeve 34 on the indexing spindle 26 providing a frictional drag on same.

It will be evident from the above description that in use as is seen in FIG. 4 of the drawings, a bottle 41 is presented by a capping machine portion 42 shown in broken lines upon which a cap 43 has been pre-positioned for full registeral engagement with the bottle 41 by the capping chuck 44 (shown in broken lines).

The bottle 41 is normally held by the capping machine's neck and supporting retaining bracket 45 encompassing a portion of the bottle neck at 46.

The star wheel 27 engages the bottle neck 44 opposite the capping machine's support and retaining bracket 43 providing additional support to the bottle neck 44 which is thus held in capping position by the opposing star wheel's bottle engagement portion 29 and capping machine's support and retaining bracket 43 respectively.

As the bottle 41 is advanced by the capping machine 42, the star wheel 27 is rotated along with its center axis index supporting spindle 26. The braking assembly 35 imparts a resistant drag to the star wheel 27 allowing for the incremental indexing of the star wheel to match each advancing bottle 41 as hereinbefore described.

Thus it will be seen that a outboard bottle support apparatus has been illustrated and described and it will be apparent to those skilled in the art that various changes and modifications may be made therein without departing from the spirit of the invention, therefore I claim:

1. An outboard bottle support apparatus for capping machines wherein said capping machines engage and move lightweight thermoplastic bottles in position for capping which requires the application of axial force thereto, said outboard bottle support comprises a pair of support and mounting tubes, a support frame extending between said tubes, said support frame having adjustable oppositely disposed vertically spaced frame elements, an indexing spindle rotatably secured to said respective frame elements, means for adjustably securing said frame elements to said support frame, a star wheel on said indexing spindle, means for adjustably securing said indexing spindle to said frame elements and braking means for said indexing spindle.

2. The outboard bottle support apparatus of claim 1 wherein said means for adjustably securing said frame elements to said support frame comprises adjustment bolts extending through elongated apertures within said respective frame elements and secured to said mounting brackets.

3. The outboard bottle support apparatus of claim 1 wherein said means for adjustably securing said indexing spindle to said respective frame elements comprises bearing support blocks on said frames, bearing assemblies within said bearing support blocks and retainer rings on said indexing spindles.

4. The outboard bottle support apparatus of claim 1 wherein said braking means for said indexing spindle comprises a support shaft extending from one of said support and mounting tubes, a synthetic resin end portion on said support shaft engaging said indexing spindle.

5. The outboard bottle support apparatus of claim 1 wherein said star wheel has a plurality of arcuate bottle engagement portions having a flange portion extending outwardly therefrom.

6. The outboard bottle support apparatus of claim 1 wherein each of said support frames has an apertured split sleeve mounting bracket extending therefrom, said split sleeve mounting bracket engaged on said respective mounting tubes.

* * * * *